United States Patent [19]

Patriarca et al.

[11] 4,198,918

[45] Apr. 22, 1980

[54] SEMI-AUTOMATIC BAILER PLUG

[75] Inventors: William C. Patriarca; Leonard J. McGraw, both of Largo, Md.

[73] Assignee: Pat-N-Mac, Inc., Largo, Md.

[21] Appl. No.: 8,576

[22] Filed: Feb. 1, 1979

[51] Int. Cl.[2] ..... B63B 13/00

[52] U.S. Cl. ..... 114/197; 114/183 R; 137/410

[58] Field of Search ..... 114/183 R, 186, 334, 114/197, 198; 137/410

[56] References Cited

U.S. PATENT DOCUMENTS

| | | | |
|---|---|---|---|
| 2,965,126 | 12/1960 | Hallinan | 137/410 |
| 3,188,994 | 6/1965 | Dawson | 114/197 |
| 3,550,548 | 12/1970 | DePersia | 114/183 R |

*Primary Examiner*—Charles E. Frankfort
*Assistant Examiner*—Frank F. Atwood
*Attorney, Agent, or Firm*—Birch, Stewart, Kolasch & Birch

[57] ABSTRACT

A semi-automatic bailer plug assembly for attachment to the transom of a boat having a bail hole therein for receiving the bailer plug assembly is described. The bailer plug is normally spring biased into a closed position to plug the bail hole until it is manually retracted by a plunger disposed in opposition to the spring. When the plunger is pulled back and the boat transom is out of the water, a pair of stop members engage the plug and hold the plug in an open position permitting the boat to be drained of water. The stop members are coupled to a pair of float members. When the transom of the boat is placed in the water a buoyant force acting against the floats releases the spring biased plunger from engagement with the stop members and permits the bailer plug to automatically close the bail hole in the boat transom.

2 Claims, 3 Drawing Figures

SEMI-AUTOMATIC BAILER PLUG

BACKGROUND OF THE INVENTION

1. Field of the Invention

The present invention relates to a device for use with boats of various sizes, such as may be launched and raised to and from the water surfaces periodically for various reasons. During such launching and raising periods bailing out of bilge water collected in the boat by some suitable means is necessary. The bilge water is discharged from a bail hole usually in the boat transom, said hole being required to be closed with a proper size bail plug when launched into the water. The novel bail plug of this invention is automatically projected into the boat transom bail hole in response to buoyant forces accompanying launching of the boat into the water.

2. Description of the Prior Art

Heretofore, there have been various arrangements of bailer plugs used to plug the transom bail hole, such as rubber stoppers, screw plugs or the like. Usually such plugs are not attached to the boat in any way. As a result, in many instances the plugs are lost or misplaced unless they are attached to the boat in some manner. Accordingly, when the boater goes to launch his craft, he must locate a bail plug to manually seal the bail hole before he can launch the same into the water.

Typical of some other prior art boat bailer plugs, which are attached to the hull of a boat, are U.S. Pat. Nos. 2,730,062 to Mitchell and 3,004,511 to Moeller, which show manually opened bail plugs and spring-biased bail plugs to close the bail holes upon manual release.

Examples of other prior art bailer plugs are illustrated in U.S. Pat. No. 3,394,671 to Mayer which discloses an automatic bailer plug including a ball float member 71 mounted in a shroad 69 adjacent the bail hole. The ball 71 in the Mayer device is water actuated under some conditions to close the bail hole.

Other U.S. Patents which show the general state of the art of bailer plugs mounted in boats are as follows:

| | | |
|---|---|---|
| 3,400,683 | DeForest | 9/10/68 |
| 3,757,726 | Moeller | 9/11/73 |
| 4,075,965 | Lasch | 2/28/78 |

None of the aforementioned prior art bailer plug arrangements disclose an assembly which is automatically actuated to close a bail hole in a boat transom in direct response to the launching of the boat into the water. Accordingly, in the prior art devices there is a danger that the boats associated with those devices will take on water as launching into the water occurs.

SUMMARY OF THE INVENTION

Accordingly, an object of this invention is to provide a semi-automatic bail plug in combination with float control means to trigger and project said plug to a closed position in a bail hole of a boat transom when the boat is launched to a water surface.

Another object of the present invention is to provide a security release means for a bail plug whereby release of the bail plug from the boat hole is only effected by manual release of the bail plug.

Briefly, the useful novel aspects of this invention reside in the provision of a novel semi-automatic bailer plug assembly wherein the bailer plug is manually cocked in an armed spring-biased open position and is triggered automatically to close the bail hole by float control means as the boat is launched to thereby project the bail plug into the bail hole.

BRIEF DESCRIPTION OF THE DRAWINGS

With the foregoing objects and advantages and other novel features which will become apparent as the invention is fully understood, the same resides in the novelty of construction, combination and arrangement of parts hereinafter described in detail and distinctly claimed in conjunction with the accompanying drawings, wherein:

DETAILS OF THE INVENTION

Figure 1:
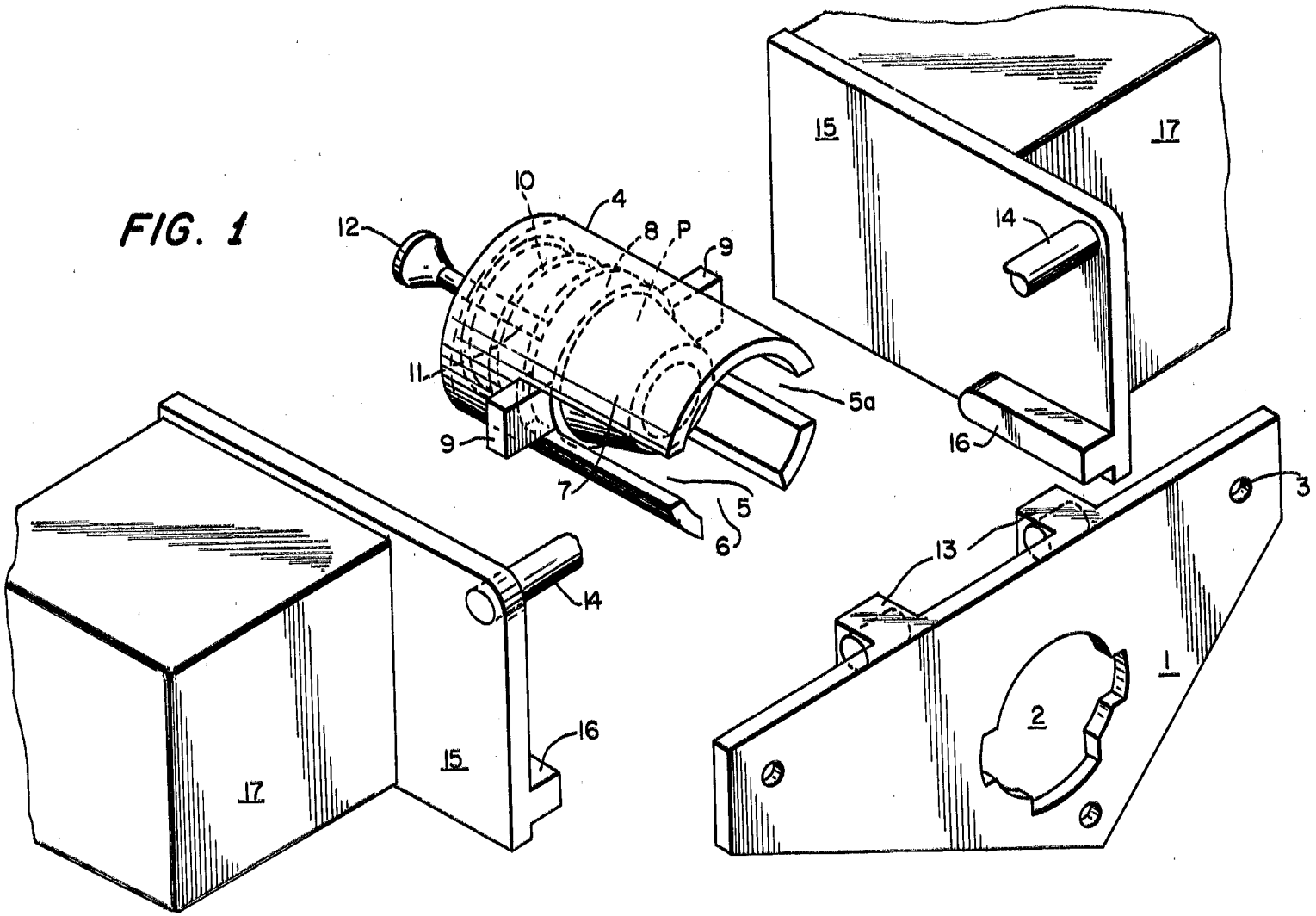
FIG. 1 is an exploded isometric or pulled apart view of the parts of the present invention, which when assembled provide the present novel invention, before attachment with respect to a suitable boat at the bail hole position.
Figure 2:
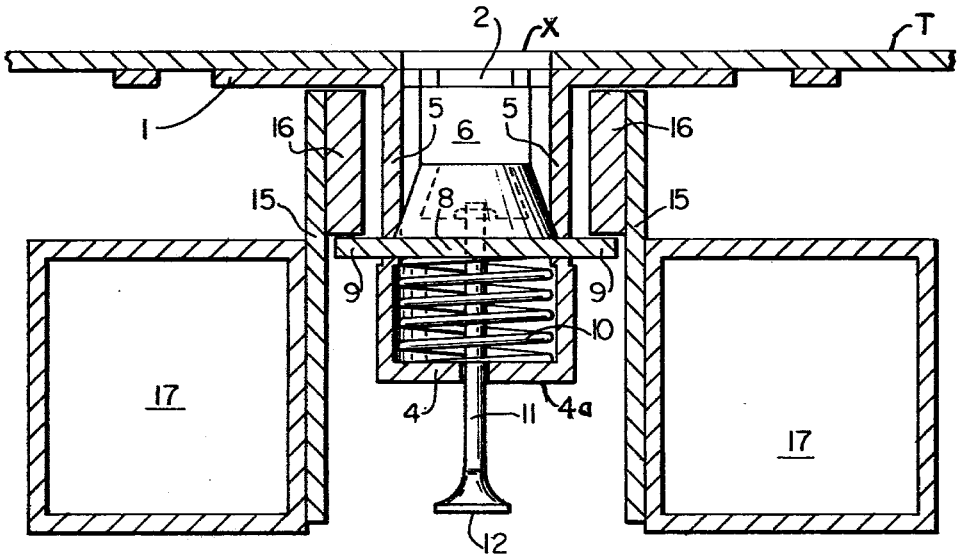
FIG. 2 is a cross section view taken along line X—X of FIG. 3 showing the mounting plate of the bail plug assembly in registry with a suitable boat transom opening, said plug assembly being in armed or cocked position.
Figure 3:
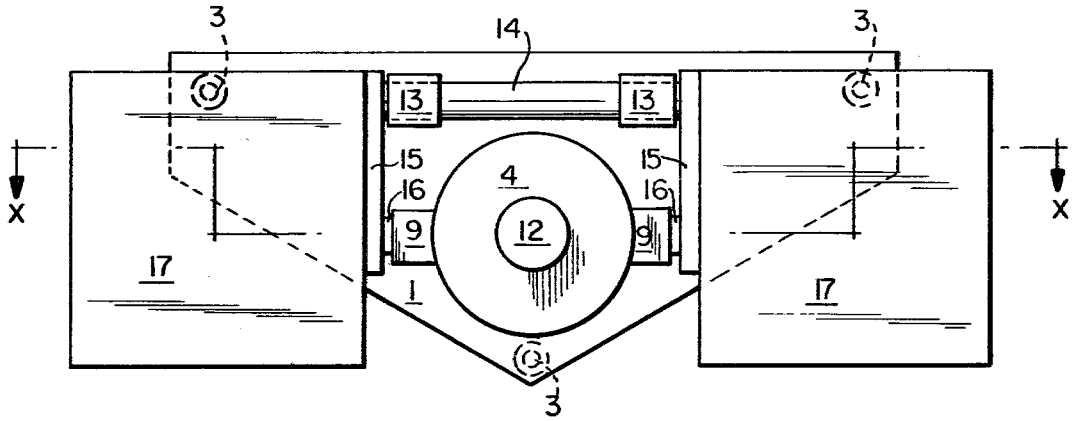
FIG. 3 is an end elevation view of FIG. 2 looking in the direction of the boat transom.

Referring in detail to the several Figures and first in reference to FIGS. 1, 2 and 3, there is shown a mounting plate 1 which may be of any shape suitable to be secured to the exterior face of a supporting boat transom T. For example, if the mounting plate is triangular only three openings 3 at each corner are needed to receive suitable fasteners, such as screws to bolts to secure the transom plate 1 to the boat transom T with a bail hole X therein. The mounting plate 1 is formed centrally above the apex portion with bail hole 2.

The bail hole plug 7 comprises a tapered leading nose P and is mounted on a plunger plate 8 guided by radial guides 9 for centering said plate as it is moved in guide slots defined by the spaced portions 5–5*a* longitudinal of the housing 4, see FIG. 1.

Preferably the bail plug housing 4 is cylindrical and closed at one end 4*a* to provide a socket terminating at a closed end wall 4*a*. The housing 4 retains a coil spring 10 with the convolutions thereof centered with respect to the shank of a rod 11 centrally connected at an end to the tapered bail plug 7 to provide for manual release of the same when desired from a carrier boat transom hole X, see FIG. 2. The plug 7 is positioned inboard of a bail plug plunger plate 8 formed with the radial guide lugs 9. Each guide lug 9 has a free end as hereinafter explained and the inboard end convolution or coil of the bail spring 10 engages with the outboard side of the bail plug plunger plate 8, see FIGS. 1 and 2.

The manual cock and release rod 11 at the outboard end thereof is formed with a handle 12 and may be pulled outward along with the plunger plate 8 and bail plug 7 to unplug the bail hole 2 and boat bail hole X. The bail plug is so arranged and positioned as to be in register with its bail hole 2 and the bail hole X of any suitable boat transom T. The mounting plate 1 is attached to the boat in aligned registry of bail holes 2 and X by the screws 3 or the like.

When the release shaft 11 is pulled outward by handle 12 the plunger plate 8 with guide lugs 9, cause the spring 10 to be compressed within the housing 4. The spring is latched by the ends of radial guide lugs 9 as long as they remain engaged with plunger stop members 16 carried by hinge plates 15 of each one of a pair of spaced floats 17. Thus the ends of plunger plate lugs 9 slide along the stop members 16 and subsequently drop off of the respective end edges of each one of the respective plunger stops 16 carried by each float hinge plate 15. The spring 10 remains in a compressed cocked or loaded condition until the floats 17—17 swing or gyrate on their respective hinge plate 15 connections in the hinge parts 13 carried by the mounting plate 1 to unload the spring 10 in response to disengagement of the lugs 9 with the stops 16, see FIGS. 1 and 2.

The floats are pivoted in response to a boat launching and the resulting reaction to water impact and pressure at the boat transom. The bail plug latched condition provided by the cocking action of the rod 11 releases to move the plunger plate 8 and guides 9 along the hinge plunger stops 16 until they disengage, whereby the bail plug is automatically projected by spring 10 as it is unloaded into the bail hole 2 and into a suitable registering bail hole X in the boat transom T of the launched boat carrying the same.

SUMMARY OF THE OPERATION

The semi-automatic bailer plug operation is believed to be generally clear from the above description in that it will function automatically to project the bail plug into the bail hole when a boat equipped with the novel assembly is first put into the water. For example, the upward force created by the water impact and the effective water buoyancy on the two spaced floats 17—17 will raise the floats in an upward direction. This further imparts such motion to the float carried hinge plates 15 to gyrate or swing about the longitudinal axis of the hinge pins 14 carried by each hinge plate 15. As this happens the round ends of plunger stops 16 of each hinge plate 15 will ride upward on the radially spaced plunger plate guides 9, and when the boat hinge plate stops 16 have cleared the ends thereof, the stored energy of the compressed spring 10 will be released. When thus released the spring will elongate and force the plunger plate 8 to move forward in the slots defined by the guides 5 and **5*a* of housing 4 in the direction of the boat transom mounting plate 1**.

The plunger plate guides 9 move within the slots provided by the spline-like guides 5 and **5*a*. This keeps the plunger plate 8 centered which in turn directs the manually cocked open bailer hole plug 7 centrally through the boat transom mounting plate bail hole 2** and into the bailer hole X in boat transom T.

Thus the tapered plug 7 is spring projected automatically and due to the taper is piloted accurately into bail hole sealing relation. No bail plug release is possible except by manual release of the rod 11, which may be termed the cocking rod. The manual release of the plug 7 to provide for bilge water discharge from the bail hole is accomplished by an outward manual pull on the handle 12 of cocking rod 11. This action will pull the plunger plate 8 fastened to the inboard end of the cocking rod 11 with the bail plug 7 out of the bailer hole in the carrier craft.

Thus, when the assembly is manually cocked to a fully open bail plug position with the bail plug out of the bail hole 2 and a registered boat bail hole X of a boat, the float members 17 gyrate or swing in a downward position about the longitudinal axis of their respective hinge pins 14 until the back edge of the hinge plates 15 of each float 17 rest against the face of mounting plate 1. Also, it is important to note that when the respective float hinge plates 15 are fully down, a release of the cocking rod knob 12 will allow the compressing force of the compression spring 10 to hold the plunger plate guides 9 pressed against the plunger stops 16, thereby holding the assembly in a normal open bail plug position allowing any bilge water to drain through the mounting plate bailer hole 2 and the bailer slot 6 of housing 4, see FIGS. 1 and 2.

The arrangement of the present invention novel assemblage provides for immediate availability of a bail plug to thereby preclude an absent minded or inexperienced boatman from launching a boat without a sealing bail plug and further provides optimum security by permitting a bail plug removal by manual means only. Thus, the advantage of an assemblage which is semi-automatic during a launching phase to apply a bail plug to float a boat and wherein the de-launching phase when completed required the plug to be manually removed from the bail hole of a boat transom to drain the boat is believed apparent.

This invention may be manufactured and distributed as an article of manufacture assembled in unitary form and the several parts thereof may likewise be made and sold as needed for replacement.

Without further description it is believed that the many advantages of the present invention over the prior art are apparent from the embodiment herein illustrated and described.

It is to be expressly understood that the invention is not intended to be limited solely as illustrated in the drawings and various changes may be made in the combination and arrangement of the parts illustrated, as will now likely appear to others and those skilled in the art. For definition of the scope of the invention, reference should be made to the appended claims.

What is claimed is:

1. A bailer plug control assembly for boat transoms having a bail hole for discharge of bilge water from a boat comprising, in combination, a mounting plate with a bail opening for alignment with a boat transom bail hole, a bail plug and a spring, said plug being spring-loaded when spaced from the boat transom bail hole, a bail plug housing formed with guide members associated with said mounting plate bail opening in registry with the bail hole of said boat transom, said plate including spaced hinge connections, spaced float means having hinge plates with pivot extensions engaged in said hinge connections, whereby said floats swing upward in reaction to water pressure around the boat when launched to project said spring-loaded bail plug into said boat transom bail hole, and manual means to remove said bail plug from the boat transom bail hole to bail out the boat after the boat is raised from the water.

2. A bailer plug control assembly for boat transoms, as described in claim 1, wherein said manual means comprises a rod connection to said bail plug, said rod having a handle at one end thereof to facilitate bail plug release and to reload said spring.

* * * * *